United States Patent [19]

Stibbe

[11] 4,197,971

[45] Apr. 15, 1980

[54] HIGH VELOCITY WEB FLOATING AIR BAR HAVING AN INTERNAL PASSAGE FOR TRANSVERSE AIR DISCHARGE SLOT MEANS

[75] Inventor: Paul H. Stibbe, DePere, Wis.

[73] Assignee: W. R. Grace & Co., New York, N.Y.

[21] Appl. No.: 950,746

[22] Filed: Oct. 12, 1978

[51] Int. Cl.[2] ..... B65H 17/32

[52] U.S. Cl. ..... 226/97; 34/57 R

[58] Field of Search ..... 226/7, 97, 196; 34/57 R, 57 A, 156; 242/75.3, 76

[56] References Cited

U.S. PATENT DOCUMENTS

| | | | |
|---|---|---|---|
| 3,448,907 | 6/1969 | Otepka et al. | 226/97 |
| 3,776,440 | 12/1973 | Frost et al. | 226/97 |
| 3,964,656 | 6/1976 | Hella | 226/97 |

*Primary Examiner*—Leonard D. Christian
*Attorney, Agent, or Firm*—James E. Nilles

[57] ABSTRACT

An elongated and generally tubular air bar having pressurized air discharge slot means extending transversely across a web to be floated by the bar, the bar having an internal air delivery passage communicating with the transverse slot means. The interior of the air bar is supplied with pressurized air which first enters the internal passage before it is delivered to the discharge slot means whereby a tortuous path is provided for the air and through which the pressurized air must pass before being discharged by the slot means against the web, thereby cross machine momentum components of air flow are dissipated before the air is discharged by the slot means against the web and uniform drying of the web in a cross machine direction is assured.

6 Claims, 12 Drawing Figures

HIGH VELOCITY WEB FLOATING AIR BAR HAVING AN INTERNAL PASSAGE FOR TRANSVERSE AIR DISCHARGE SLOT MEANS

BACKGROUND OF THE INVENTION

The invention pertains to air bars for floating a running web so that the material, such as ink on a web is dried before the web contacts any support means. The invention is in the nature of an improvement over U.S. Pat. No. 3,549,070 which issued Dec. 22, 1970 to Frost et al and entitled "Floatation of Sheet Materials"; U.S. Pat. No. 3,873,013 which issued Mar. 15, 1975 to Paul H. Stibbe entitled "High Velocity Web Floating Air Bar having Central Exhaust Means"; U.S. Pat. No. 3,776,440 which issued Dec. 4, 1973 to Frost et al and entitled "Web Handling Apparatus"; or U.S. Pat. No. 3,964,656 which issued June 22, 1976 to Terry A. Hella, and entitled "Air Bar Assembly for Web Handling Apparatus."

In web drying equipment of the type shown in the above U.S. patents and others, pressurized air is introduced into the interior of the air bar and is then generally permitted to issue directly through transversely positioned, air discharge slots against the running web. Such prior devices sometimes caused nonuniform drying of the web across the web width due to the fact that the air was discharged from the slots unevenly along the length of the slots and in directions other than right angles to the transverse width of the web. The resulting cross machine momentum components of air movement resulted in uneven drying of the web across its width.

SUMMARY OF THE INVENTION

The present invention provides an elongated, generally tubular air bar which is adapted to be positioned closely to and transversely of a running web for supporting the web on a cushion of air between the air bar and the web, the air bar including air discharge slot means through which pressurized air is directly against the running web. The interior of the air bar receives pressurized air and also has an air delivering passageway therein and which is located between the general interior of the air bar and the air discharge slot means so as to form a tortuous path through which the pressurized air must pass from the general interior of the air bar to the air discharge slot means. This tortuous path for the air movement causes the cross machine momentum components of air flow to be dissipated before the air reaches the discharge slot means, thereby causing the air to be discharged from the slot means in a generally normal direction to the transverse width of the web, which results in uniformity of web drying in a transverse direction.

A more specific aspect of the invention provides an air bar of the above type in which the interior passage between the interior of the air bar and the air discharge slot means is formed by an elongated and a generally U-shaped in cross section member which can be utilized in conventional, prior art air bars.

These and other objects and advantages will appear as this disclosure progresses, reference being had to the accompanying drawings.

DESCRIPTION OF A PREFERRED EMBODIMENT

Figure 1:
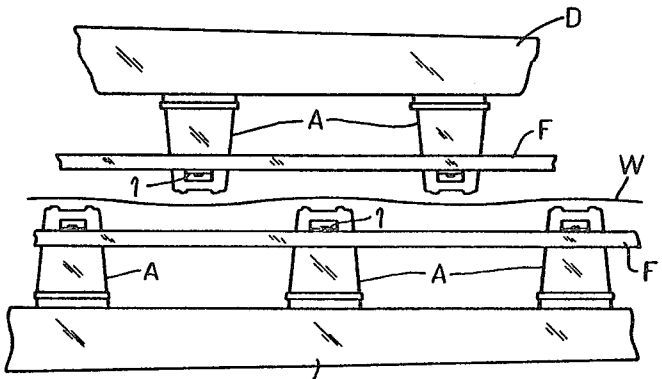
FIG. 1 is a schematic side elevational view of a plurality of air bars made in accordance with the present invention and conventionally arranged on opposite sides of a running web and in staggered relationship from one another from one side of the web to the other.

A general organization of a plurality of air bars made in accordance with the present invention is shown in FIG. 1, the air bars A being secured by brackets 1 to the frame F of the machine with which they are used. The air bars are secured to a duct D in the conventional manner, for example as shown in the U.S. Pat. No. 3,739,491 of June 19, 1973 which issued to Creapo et al and entitled "High Velocity Air Web Dryer" or as shown in the said U.S. Pat. No. 3,873,013. It is believed sufficient to say that pressurized air is fed from the duct via opening 3 in the inner side 3*a* of the air bar and into the central chamber 4 of the generally tubular and elongated air bar A.

Figure 2:
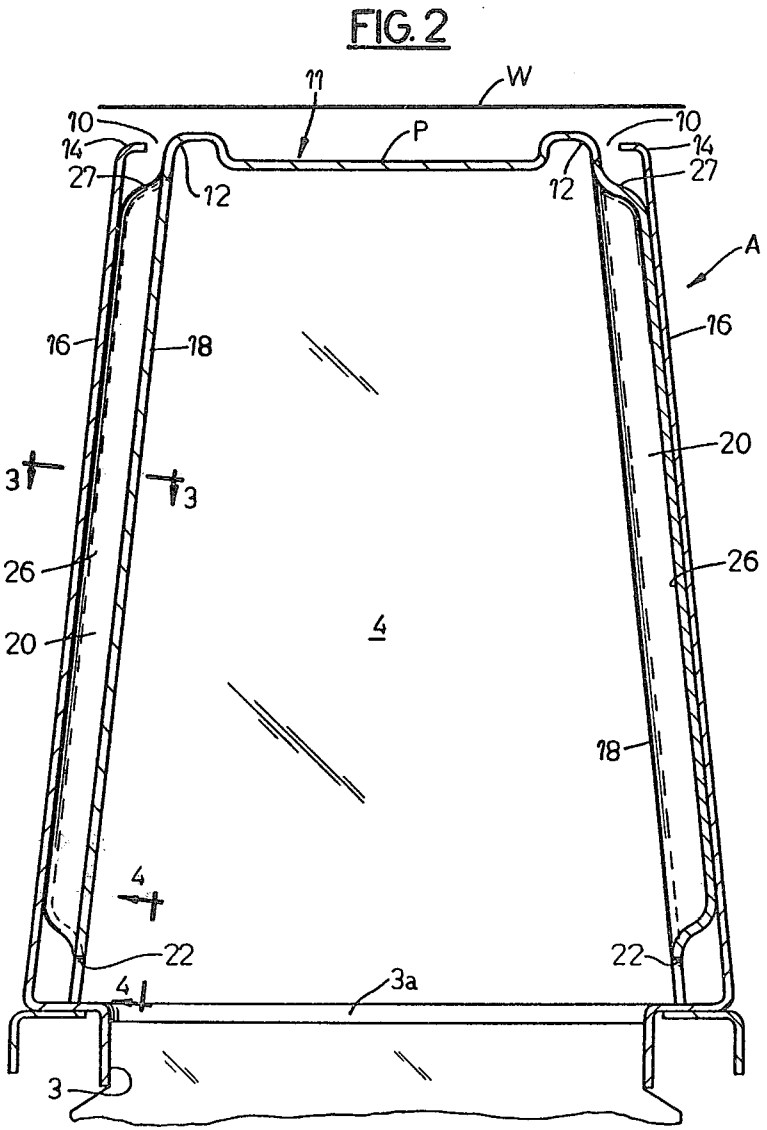
FIG. 2 is an enlarged, cross sectional view through an air bar made in accordance with the present invention.
Figure 6:
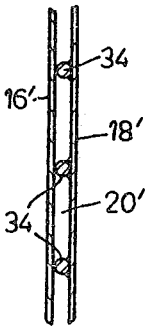
FIG. 6 is a cross sectional view taken generally along the line 6—6 in FIG. 5.

The air bar A is positionable closely adjacent the running web W for supporting the web on a cushion or zone of pressurized air that is developed between the air bar and the web. The air bar includes air discharge slot means as shown in FIG. 2, in the form of a pair of spaced apart air discharge slots 10 located generally in the outer side 11 of the air bar. These slots extend transversely across the web W. Located between the slots is a plate P having rounded corners or edges 12 that define one side of the air nozzle. The other side of the air discharge slots 10 is formed by a nozzle edge or lip 14 which extends closely adjacent the curved edge 12 but terminates short of it to define the slot 10. The lip 14 forms the upper portion of the side walls 16, two such side walls being utilized in the FIG. 2 showing. The air bar also includes inner wall means 18 located adjacent to but spaced from and in general parallelism with each of the outer side walls 16. In this manner the walls 16 and 18 together define a separate air delivering passageway 20 along each side of the air bar and which passageway communicates with the central chamber 4 via openings 22 (FIGS. 2, 4 and 6) and the passageway also communicates with the air discharge slots 10 at the outer end of the air bar.

Figure 3:
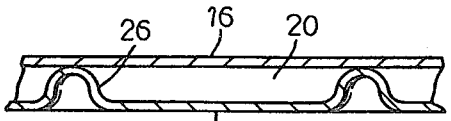
FIG. 3 is a cross sectional view taken generally along the line 3—3 in FIG. 2.
Figure 4:
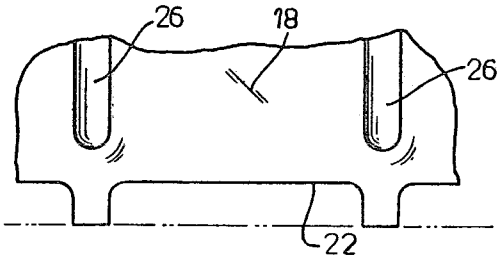
FIG. 4 is a view taken generally along the line 4—4 in FIG. 2.

Formed within the air delivering passageway 20 are air flow straightening means which in the FIGS. 2 to 4 modification are formed by elongated raised portions or flutes 26 that are pressed into the inner wall means 18. It will be noted that the upper end 27 (FIG. 2) of the flutes terminates a short distance from the lip 14 on the nozzle thereby providing a rigid structure and a good support for the overhanging lip of the nozzle. This results in maintaining the discharge slots of constant width and this slot gap is easier to maintain in practice than conventional air bars. The short support span for the lip of the nozzle is thus possible because the flutes can be extended closely adjacent the discharge slot.

The outer walls 16 are rigidly secured to the flutes, for example as by plug welding, thus forming a rigid structure which is economical to manufacture and the shape of the air bar and straighteners thereof can be maintained.

Figure 7:
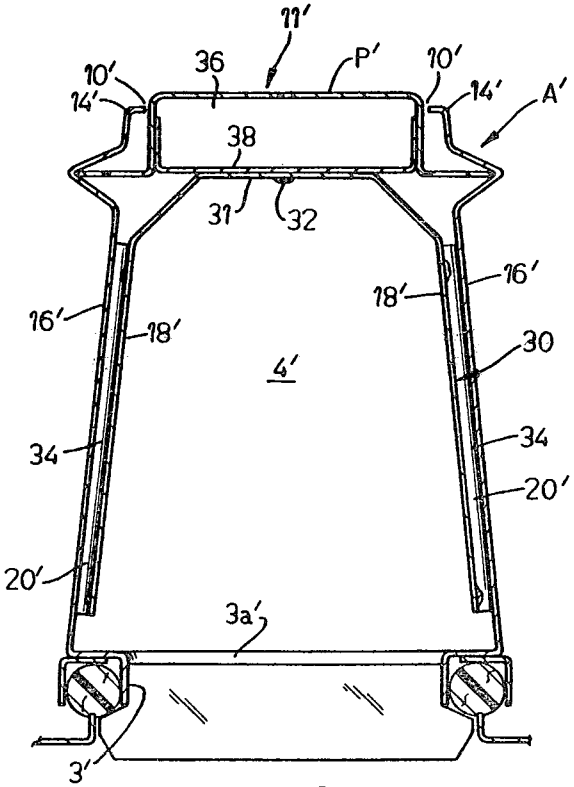
FIG. 7 is a cross sectional view similar to FIG. 2, but showing another modified form of air bar using the present invention.
Figure 5:
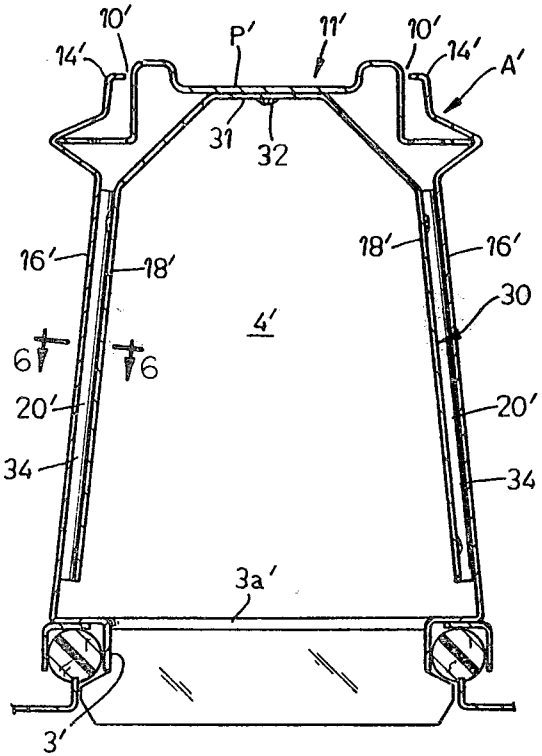
FIG. 5 is a cross sectional view similar to FIG. 2, but showing a modified form of air bar using the present invention.
Figure 8:
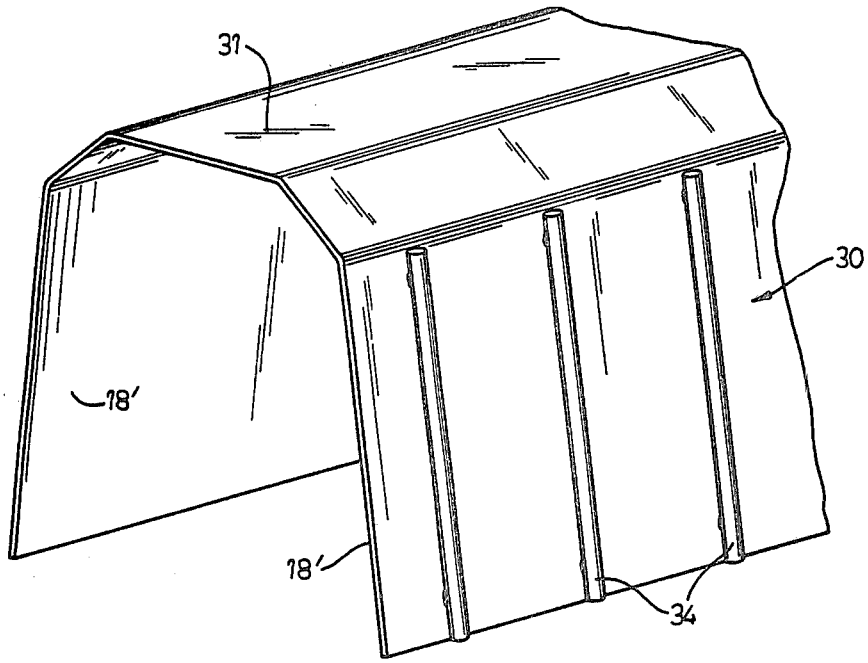
FIG. 8 is a fragmentary, perspective view of an air passageway forming insert as shown in FIGS. 5 and 6, but on an enlarged scale.

The modification shown in FIGS. 5 and 7 have been numbered similarly to the FIG. 2 showing with certain exceptions as will appear. The general organization and operation of these modifications is generally the same as the FIG. 2 showing except the inner walls 18′ are here formed by the generally U-shaped, elongated metal insert structure 30 shown in FIG. 8 which extends coextensively in length with the air bar. The bight portion 31 of the member 30 can be spot welded as at 32 to the intervening plate P′ located between the discharge nozzle 10 as shown in FIG. 5. In this embodiment the air flow straightening means is formed by a series of elongated strips, such as metal rods which may be secured as by welding to the inner wall 18′ at spaced apart locations thereon and in general parallelism with one another.

The modification shown in FIG. 7 may be an air bar of the type shown in the said U.S. Pat. No. 3,873,013 or in the said U.S. Pat. No. 3,964,656 and which include an air return chamber 36 that is defined in part by an inner wall member 38. In this embodiment the bight portion 31 of member 30 is spot welded at 32 to the member 38.

Figure 10:
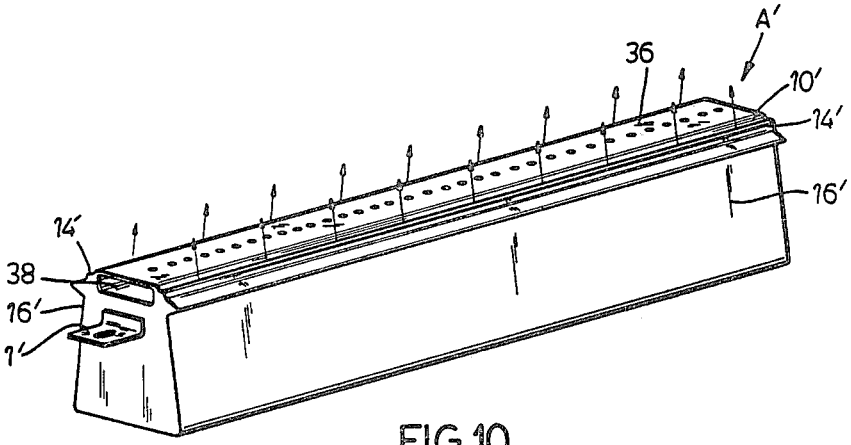
FIG. 10 is a perspective view of the bar shown in FIG. 7, but on a reduced scale, and for the purpose of showing the direction and magnitude of the air flow from the transverse air discharge slots in the air bars of the present invention.

FIG. 10 shows the air bar of FIG. 7 and more particularly the flow of air through the slots and in a generally normal direction to the slots and at right angles to the web in a transverse direction of the web, thereby insuring uniform drying of the web across its width.

Figure 9:
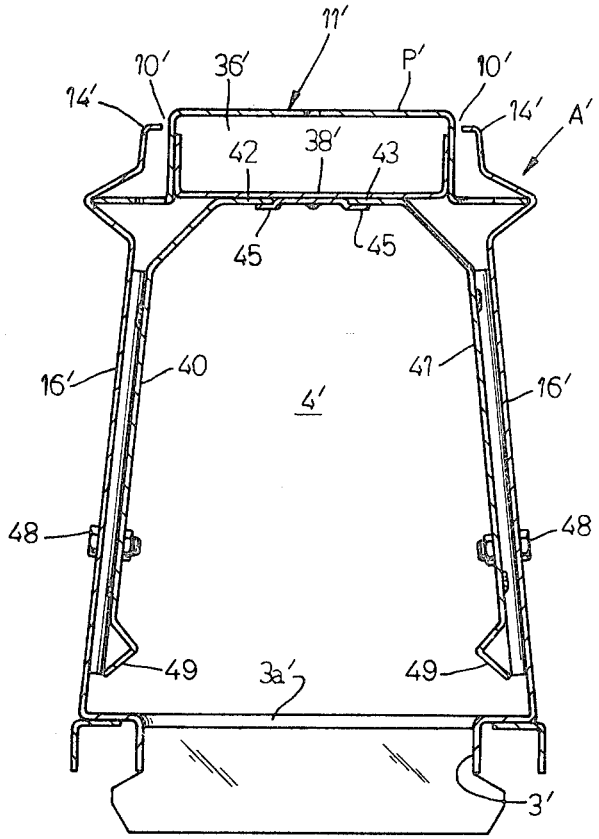
FIG. 9 is a view similar to FIG. 7, but showing a modified form of air passageway insert in accordance with the present invention.

The modification shown in FIG. 9 shows a conventional air bar of the type shown in FIG. 7. The internal passage forming insert however is of modified form and includes a pair of separate inner side walls 40, 41 each of which have inwardly turned, short flanges 42, 43, respectively, at their upper edges and which are easily insertable in the angle brackets 45 that are secured to the inner wall member 38 as by welding. These side walls 40, 41 are thus easily insertable along their upper edges into the brackets and are secured to the outer side walls of the air bar by the bolt means 48 extending therethrough. The passageway 20 of FIG. 2 may become plugged with particulate matter on certain drying applications. The modification shown in FIG. 9 allows the inner side wall members 40 and 41 to be detached from the air bar sides by removing bolt means 48, and then pivoted about their inner flanges 42, 43 toward the longitudinal center of the bar, and then cleaned. When clean, they can be reassembled into position and clamped up by bolt means 48. The V-break 49 shown is a stiffening rib along the air entry edge since bolts 48 occur only at the air bar inlets where they are accessible.

Figure 11:
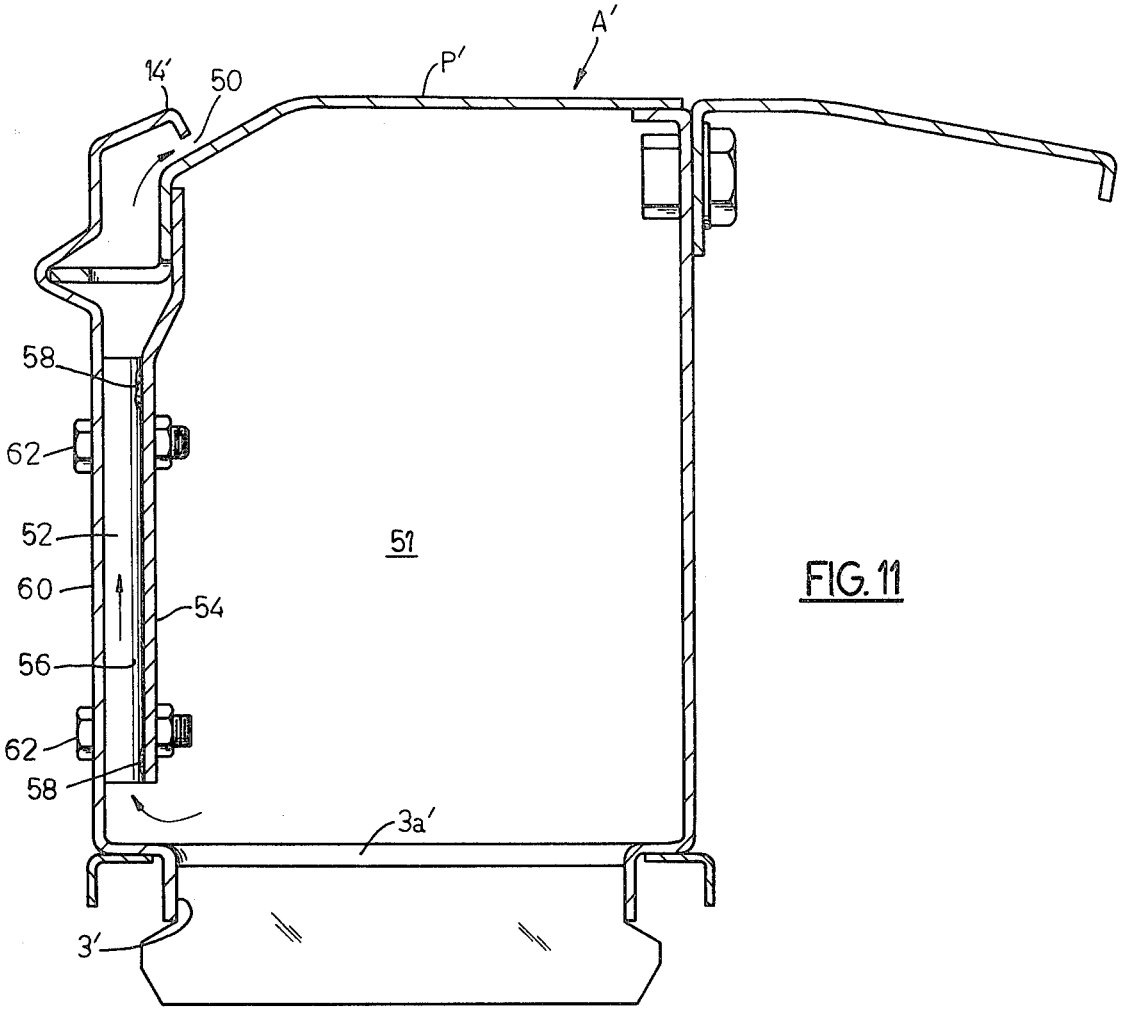
FIG. 11 is a cross sectional view through a modified air bar having a single air slot and embodying the present invention.
Figure 12:
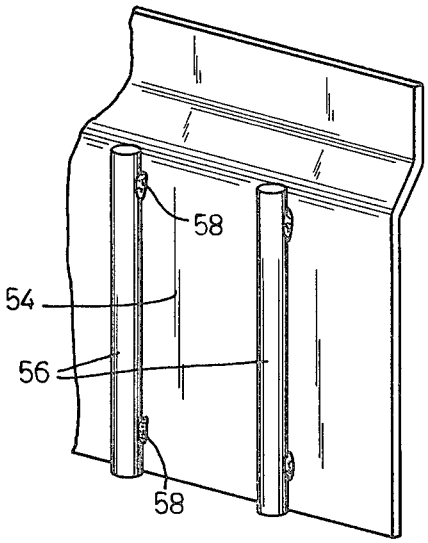
FIG. 12 is a fragmentary, perspective view of an air passageway forming an insert as shown in FIG. 11, but on a reduced scale.

The modified single slot air bar shown in FIG. 11 has parts similar to those shown in the other figures, but includes only a single air discharge slot 50 from which pressurized air is delivered from the pressurized central chamber 51 and through the air delivering passageway 52, as indicated by the arrows in FIG. 11. A single wall insert 54 has metal rods 56 welded thereto as at 58 and which are located within the passageway 52. The single wall insert 54 is removably attached to the outer wall 60 of the air bar by the bolt means 62, thus enabling the interior of the bar and particularly the passageway 52 to be cleaned, which is desirable in high particulate or dirty situations.

RECAPITULATION

The present invention provides separate internal passages in the interior of the air bar and through which the pressurized air must pass in a tortuous path as it is fed from the central pressurized chamber 4 of the air bar and then through the air discharge slots 10. This controlling of the air through the tortuous path dissipates cross machine components of air movement and causes the air to be directed outwardly through the discharge slots and uniformly along the length thereof to thereby result in uniformity of drying of the web across its width.

I claim:

1. An elongated air bar assembly for being positioned transversely of and adjacent to a running web for supporting said web on a cushion of air, said elongated assembly comprising, an outer side adapted to be positioned closely adjacent said web, an inner side having means communicating with an air supply, and two opposite and spaced apart side walls which together with said outer and inner sides define a pressurizable central chamber into which pressurized air is conducted, an air discharge slot located along said outer side, said slot being defined by said outer side and one of said side walls, and inner wall means located along and adjacent to, but spaced inwardly from said one of said side walls, said inner wall means extending generally coextensive in size with said one of said side walls to thereby define therewith an air delivering passageway to said slot, said passageway being in air receiving communication at a location generally adjacent said inner side and with said central chamber for receiving pressurized air from said central chamber, whereby the air entering said central chamber then enters said passageway for discharge through said slot for impingement against said web.

2. An elongated air bar assembly for being positioned transversely of and adjacent to a running web for supporting said web on a cushion of air, said elongated assembly comprising, an outer side adapted to be positioned closely adjacent said web, an inner side having means communicating with an air supply, and two opposite and spaced apart side walls which together with said outer and inner sides define a pressurizable central chamber into which pressurized air is conducted, an air discharge slot located along each longitudinal edge of said outer side, said slots being defined by said outer side and said side walls, said inner wall means located along and adjacent to, but spaced inwardly from said side walls, said inner walls extending generally coextensive in size with said side walls to thereby define therewith air delivering passageways to said slots, said passageways being in air receiving communication at a location generally adajcent said inner side and with said central chamber for receiving pressurized air from said central chamber, whereby the air entering said central chamber then enters said passageways for discharge through said slots for impingement against said web.

3. The assembly set forth in claim 2 including an elongated, generally U-shaped member having a pair of walls and a bight portion between said walls, said walls constituting said inner wall means, and said bight portion positioned generally along said outer side.

4. The assembly set forth in claim 3 including means for removably attaching said U-shaped member in said assembly.

5. An elongated and generally tubular air bar adapted to be positioned closely adjacent a running web for supporting said web, said air bar including two side walls and an outer side therebetween, said air bar defining a pressurizable central chamber into which pressurized air is conducted and having means communicating with a pressurized air supply, said bar having air discharge slot means located adjacent and along said outer side and for discharging air against said web, an elongated, generally U-shaped member having a pair of walls and a bight portion between said walls, said bight portion positioned generally along said outer side, and an air deliverying passageway in said bar and communicating with said slot means and also in air receiving communication with said central chamber for receiving pressurized air therefrom, said U-shaped member together with said side walls defining said passageway whereby pressurized air in said central chamber enters said passageway for discharge through said slot means for impingement against said web.

6. The assembly set forth in claim 5 including a single wall insert secured in said bar and defining therewith said passageway.

* * * * *